United States Patent [19]

Rossum

[11] 3,986,423

[45] Oct. 19, 1976

[54] POLYPHONIC MUSIC SYNTHESIZER

[75] Inventor: David Philip Rossum, Santa Clara, Calif.

[73] Assignee: Oberheim Electronics Inc., Santa Monica, Calif.

[22] Filed: Dec. 11, 1974

[21] Appl. No.: 531,546

[52] U.S. Cl. ..... 84/1.01; 84/1.03; 84/1.24; 84/1.26

[51] Int. Cl.[2] ..... G10H 1/00

[58] Field of Search ..... 84/1.01, 1.17, 1.19, 84/1.03, 1.24, 1.26

[56] References Cited

UNITED STATES PATENTS

| | | | |
|---|---|---|---|
| 3,515,792 | 6/1970 | Deutsch | 84/1.03 |
| 3,610,799 | 10/1971 | Watson | 84/1.26 X |
| 3,828,110 | 8/1974 | Colin | 84/1.24 X |
| 3,844,378 | 10/1974 | Tomisawa et al. | 84/1.01 |
| 3,878,750 | 4/1975 | Kapps | 84/1.01 |

*Primary Examiner*—Ulysses Weldon
*Attorney, Agent, or Firm*—Lindenberg, Freilich, Wasserman, Rosen & Fernandez

[57] ABSTRACT

An electronic music synthesizer including a keyboard control system for enabling multiple independent voice channels (voices) to be controlled by the keyboard in a musically pleasing manner. The control system responds to a keyboard of M keys to control N voices where N<M; e.g. M=64 and N=10. The voice channels are preferably identical to one another, each being comprised of voltage controlled elements such as an oscillator (VCO), amplifier (VCA) and filter (VCF). Typically, the control system selects an available voice channel and in response to a key depression, supplies a DC control voltage thereto whose level is nominally linearly related to the note corresponding to the depressed key. In addition to the control voltage, the control system supplies a gate signal to the selected voice channel indicating the time duration of the key depression. The control system is essentially comprised of keyboard control logic and channel selection logic, both common to all of the voice channels, and channel logic units, each unique to a different voice channel. The keyboard and channel selection logic operates to assign voice channels to key depressions by sequentially sampling (scanning) the keys during a scan cycle to determine whether or not each key is depressed. Scanning is performed by a key address counter driven by clock pulses. When a depressed key is first recognized, the count in the address counter is, subject to certain logic criteria, written into a register contained in the channel logic associated with the selected voice channel. Additionally, the DC control voltage and gate signal are supplied to the selected voice channel. The channel selection logic is structured to assure that no voice channel receiving an active gate signal is pre-empted by a new key depression. Whether or not more than one voice channel can be assigned to a single key is determined by a user controlled REASSIGN mode switch. The criteria employed by the channel selection logic to select a voice channel for assignment is determined by a user controlled RESET mode switch.

19 Claims, 4 Drawing Figures

POLYPHONIC MUSIC SYNTHESIZER

FIELD OF THE INVENTION

This invention relates generally to electronic musical instruments and more particularly to improvements in a polyphonic music synthesizer.

BACKGROUND OF THE INVENTION

An electronic music synthesizer is a keyboard instrument capable of producing sound whose characteristics, such as pitch, timbre, loudness, etc. can be controlled by the user. Such synthesizers have been commercially available for several years (e.g. Odyssey Model 2800 sold by Arp Instruments, Inc., Newton, Massachusetts) and are generally comprised of elements such as oscillators, amplifiers, filters, and envelope generators whose operating characteristics are controlled by DC voltage levels applied thereto by the user.

As was recognized in U.S. Pat. No. 3,715,444, prior art synthesizers have been limited in that they are single voiced or monophonic instruments; i.e. they are capable of playing only one note at a time. U.S. Pat. No. 3,715,444 is accordingly directed to a polyphonic musical instrument which includes multiple voice channels which can operate simultaneously to produce sound. However, the system disclosed in U.S. Pat. No. 3,715,444 requires complex multiple contact switches, employs a rather inflexible set of channel assignment rules, and is not easily expandable.

U.S. Pat. No. 3,733,955 is also directed to means for providing a synthesizer with more than one voice. However, the system disclosed in this patent is limited to two voices.

SUMMARY OF THE INVENTION

The present invention is directed to an improved polyphonic music synthesizer and more particularly to an improved keyboard control system therein for assigning key depressions to voice channels.

In accordance with an important aspect of the present invention, key depressions are assigned on a time priority basis and once assigned to a voice channel, that voice channel will remain dedicated to that particular key depression until the key is released.

In the preferred embodiment of the invention, the keyboard control system is essentially comprised of keyboard control logic and channel selection logic, both common to all of the voice channels and channel logic units, each unique to a different voice channel. The keyboard control logic includes an address counter which defines a scan cycle comprised of a plurality of different address counts, each address count defining a time slot during which the state of a different key is sampled. If a sampled key is depressed (closed), then the channel selection logic may assign the depressed key to a voice channel previously selected by the channel selection logic as being available. Alternatively, if the key was previously assigned to a voice channel, then the previously assigned channel logic unit immediately advises the other channel logic units that this key is "taken" and the assigned channel is merely updated.

In accordance with a further aspect of the invention, a REASSIGN mode can be defined by the user in which an already assigned key can be reassigned to an additional channel to achieve a desirable musical effect.

In accordance with a still further aspect of the invention, the channel selection logic includes a channel select counter capable of defining a number of different states at least equal to the number of different voice channels. When the channel selection counter identifies a channel as being busy, this fact is promptly recognized and the counter is incremented. Thus, the counter steps along until it locates an available channel.

In accordance with a still further aspect of the invention, in order to achieve different musical effects, a RESET mode switch is available to the user for enabling him to define when the channel selection counter is reset; e.g. once per scan cycle, after each scan cycle in which no key depressions are sensed, or never.

In accordance with a still further aspect of the invention, the keyboard control logic includes a common digital-to-analog converter utilized to develop the DC control voltages for application to the voice channels.

The converter tracks the changing key address count to provide a staircase analog output voltage. When a key depression is assigned to a channel, a sample and hold circuit in the channel's logic unit samples the converter analog output.

In accordance with a still further aspect of the invention, means are provided for selectively varying the relationship between the address and the analog voltage developed by the converter in order to produce variously tempered music scales.

DESCRIPTION OF THE PREFERRED EMBODIMENT INTRODUCTION

Figure 1:
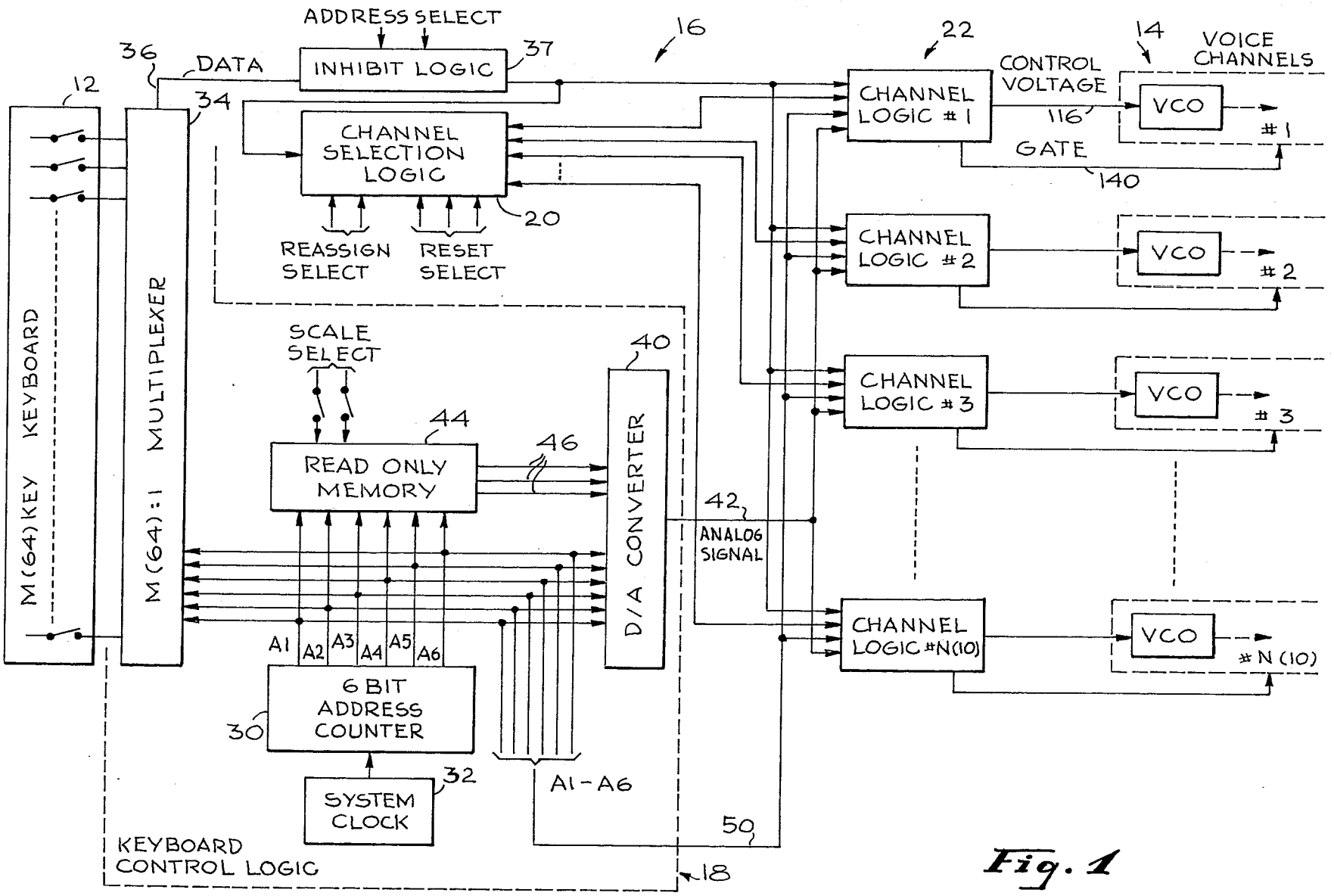
FIG. 1 is a block diagram of a polyphonic music synthesizer in accordance with the present invention.

Attention is now called to FIG. 1 which illustrates a block diagram of a polyphonic music synthesizer in accordance with the present invention. The synthesizer is essentially comprised of a keyboard 12, including M individually actuatable keys, and a plurality of N independent voice channels 14. Although the teachings of the present invention are applicable to synthesizers employing essentially any number of keys or voice channels, the exemplary embodiment of the invention disclosed herein will be assumed to consist of 64 keys and 10 voice channels. The 64 keys will herein be respectively referred to as key 1, key 2, key 3, . . . . key 64. Similarly, the voice channels will be respectively referred to as voice channel 1, voice channel 2, . . . voice channel 10.

The keyboard 12 comprises a standard keyboard of the type employed in conventional music synthesizers and accordingly is not described herein in detail. It essentially consists of 64 individually actuatable single pole single throw switches biased to be normally open. When a key is depressed by the user, the key will close and remain closed only so long as the user continues to depress the key.

The plurality of voice channels 14 are preferably similar to one another and each consists of a plurality of voltage controlled elements such as an oscillator (VCO), an amplifier (VCA), a filter (VCF) and other elements. The voice channels will not be described in detail herein because each individual voice channel can be identical to a voice channel of the type typically found in conventional monophonic synthesizers. Each voice channel is responsive to the application of a control voltage and a gate signal thereto to produce a sound having a certain pitch and a certain duration. More particularly, as is readily known in conjunction with conventional monophonic synthesizers, the voice channel will produce a sound whose pitch is related to the level of the DC control voltage supplied thereto. Thus, typically if a one volt control voltage is applied to the voice channel, it will produce a sound of a certain pitch and if the control voltage level is then increased to two volts, the pitch will be correspondingly increased by one octave, i.e. the frequency will be doubled.

The gate signal supplied to each voice channel determines the duration of the sound produced. That is, the sound will be initiated when the gate signal first appears and will be terminated in response to the termination of the gate signal. As is well known, the voice channel may include envelope generator means for shaping the attack and decay portions of the sound.

The present invention is primarily directed to the control system 16 of FIG. 1 for responding to key depressions on the keyboard 12 to appropriately activate the voice channels 14. More particularly, the control system 16 may be viewed as an apparatus for servicing the keyboard so as to provide appropriate control voltage and gate signal information to the voice channels so as to permit multiple notes to be played concurrently. An essential function of the control system 16 is to service the key depressions on keyboard 12 and assign the key depressions to the voice channels in a manner to produce a musically pleasing effect.

Figure 3:
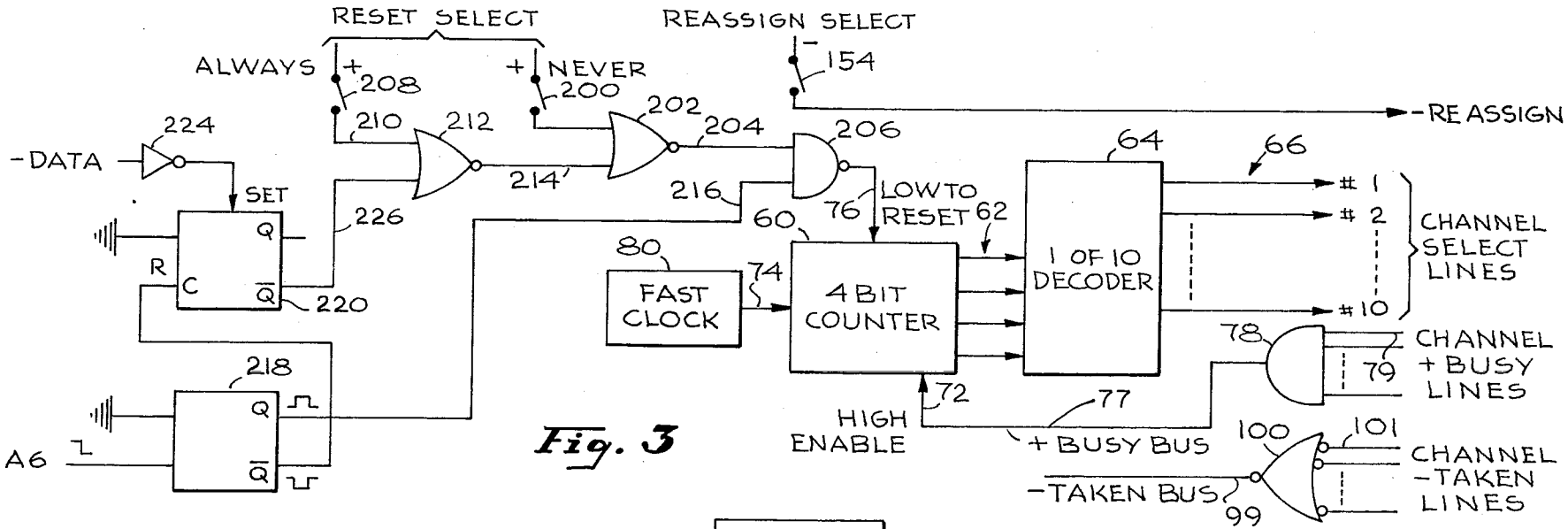
FIG. 3 is a logic block diagram illustrating the channel selection logic of FIG. 1 in greater detail.
Figure 4:
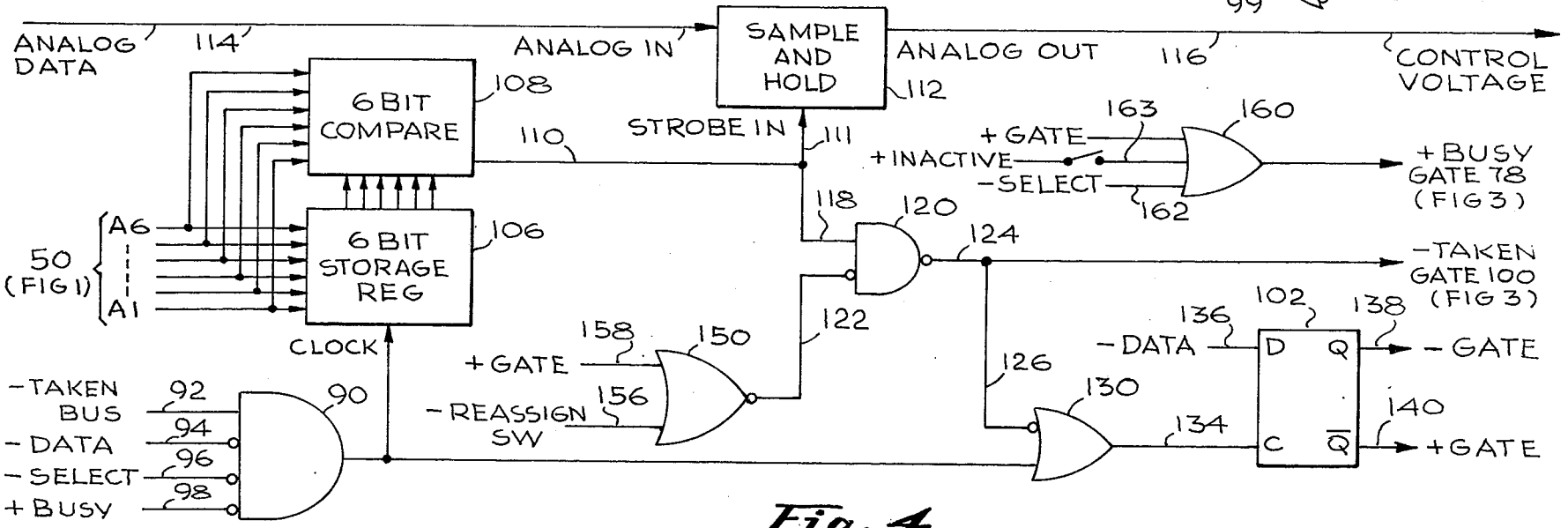
FIG. 4 is a logic block diagram illustrating one of the channel logic units of FIG. 1 in greater detail.

The control system 16 can reasonably be said to be comprised of three portions; namely, a keyboard control logic portion 18, a channel selection logic portion 20, and a plurality of channel logic units 22. The keyboard control logic 18 and the channel selection logic 20 are each common to all of the voice channels 14. Each of the plurality of channel logic units 22 is, on the other hand, connected to and dedicated to a different voice channel. Accordingly, reference herein may, for example, be made to channel logic unit 2 and this should be understood as meaning the channel logic unit shown in FIG. 1 whose control voltage and gate signal output lines are connected to voice channel 2. All of the channel logic units are identical and a logic block diagram of one such channel logic unit is illustrated in FIG. 4 hereof. A logic block diagram of the channel selection logic 20 common to all of the voice channels is illustrated in FIG. 3 hereof.

OPERATION

Prior to considering in detail the three aforementioned portions of the control system 16, the overall operation of the synthesizer of FIG. 1 will be briefly described in order to clarify the functions to be performed by each of the control system portions.

A primary function of the keyboard control logic is to sequentially scan the 64 keys to determine whether each key is open or closed. Additionally, the keyboard control logic produces an analog signal which increases during the scan cycle so that its level is essentially linearly related to the position of the key, within the 64 keys, being sampled. The channel selection logic 20 functions to locate an available voice channel and to assign each key depression sampled by the keyboard control logic to the available voice channel. As will be seen hereinafter, the channel selection logic 20 is seeking an available voice channel, samples the channel logic units in sequence to locate a voice channel which is not busy. In assigning a particular key depression to a voice channel, the channel selection logic 20, in conjunction with the channel logic units 22 first determines whether the particular key to be assigned has previously been "taken" by a channel.

Each channel logic unit 22 includes a digital register which stores the address or identity of the particular key it is then servicing. Storage of the key address enables the channel logic unit to examine a new key depression to determine whether or not it is then servicing that key. If it is, then that channel logic unit will identify to the channel selection logic 20 that it has "taken" that key. In addition, each channel logic unit is able to identify to the channel selection logic 20 when its voice channel is busy. Each channel logic unit, based on the input information supplied thereto, develops a control voltage and gate signal for activating the voice channel connected thereto.

KEYBOARD CONTROL LOGIC

The keyboard control logic 18 is comprised of a six bit address counter 30 having six output lines respectively identified as A1, A2, . . . A6. The address counter 30 is driven by a clock pulse source identified as system clock 32. As should be readily appreciated, the six bit address counter 30 is capable of defining 64 unique six bit addresses. Each six bit address identifies a different one of the 64 keys and each different six bit address occurs during a unique time slot in which the state of the addressed key is sampled. More particularly, referring to FIG. 2, line (a) illustrates the output of the system clock pulse source 32. Lines (b)-(g) respectively illustrate the waveforms produced on the output lines A1-A6 of the address counter. One complete cycle of the address counter 30 is referred to as a scan cycle. The scan cycle is comprised of 64 successive sample time slots and, as will be seen hereinafter, during each time slot the state of a different one of the 64 keys is sampled. The scan rate preferably should be selected such that one complete scan cycle is slightly longer than the maximum contact bounce time for the keyboard so as to thereby suppress spurious key depression inputs. For the typical embodiment disclosed, an appropriate scan cycle could be on the order of 10 msec.

Figure 2:
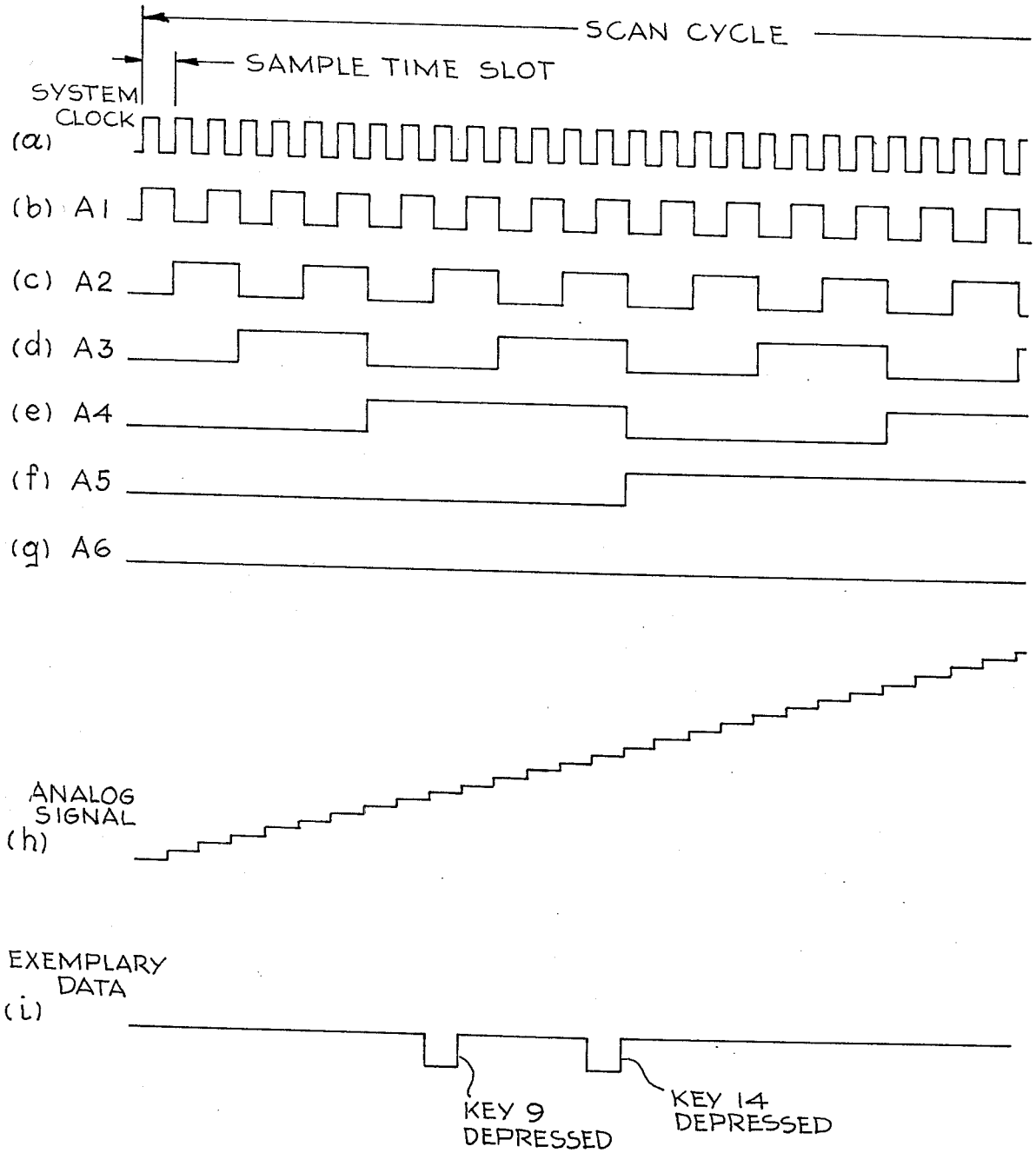
FIG. 2 is a waveform diagram illustrating waveforms occurring within the keyboard control logic of FIG. 1.

The address counter output lines A1-A6 are connected to the input of a conventional 64:1 multiplexer 34. The multiplexer 34 produces a data signal on the output line 36 which comprises a series of bit pulses representing the state of the keys. Line (i) of FIG. 2 represents an exemplary data signal waveform which would appear on multiplexer output terminal 36 in the event keys 9 and 14 are depressed during a scan cycle. The data signal line 36 preferably includes an inhibit logic circuit 37 capable of suppressing data signal bits associated with certain keys. More particularly, the logic circiut 37 includes user actuatable switches enabling the user to identify certain key addresses. When these addresses are defined by the address counter 30, the logic circuit 37 inhibits the data bits from being coupled through to the channel selection logic 20 and channel logic units 22. This capability enables the user to selectively disconnect a portion of the keyboard from the voice channels so as to make that keyboard portion available for special musical effects.

Address counter output lines A1-A6, in addition to being applied to the multiplexer 34, are also applied to the input of a digital-to-analog converter 40 for producing the staircase analog signal represented in line (*h*) of FIG. 2 on the converter output terminal 42 of FIG. 1. The converter output terminal 42 is coupled to each of the channel logic units 22. Thus, it should be appreciated that as the address counter 30 steps through the 64 successive addresses, i.e. from key 1 to key 64, the converter 40 will be simultaneously producing the staircase analog signal of line (*h*) of FIG. 2.

By using the staircase analog signal produced by the converter 40 to drive a voltage controlled oscillator, successive notes can be played whose frequencies differ by a uniform amount. In musical terms, this is referred to as an equal tempered scale. As is well known by those skilled in the musical art, an equal tempered scale is quite appropriate for certain types of music. However, for other types of music, e.g. Polynesian music, it is desirable that the scale not be even tempered but rather that there be certain non-uniform differences in pitch between adjacent notes. In order to permit this in accordance with the present invention, the keyboard control logic 18 incorporates a read only memory 44. The six bit address developed by the address counter 30 is applied to the read only memory 44 which in turn can supply bits on memory output lines 46 to the input of the converter 40 so as to modify the precise linear relationship between six bit digital input and analog output. External switch means are provided to enable a user to select a particular scale. Depending upon the scale selected, the read only memory 44 would provide bits on output lines 46 representing the deviation from the equal tempered scale, for a particular note. The effect of the memory 44 providing these additional bits to the input of the converter 40 is, of course, to offset the levels of the staircase waveform of line (*h*) of FIG. 2 in a desired manner to achieve the musical effect desired.

The invention is, of course, not restricted to utilizing any limited number of different scales. Rather, the number of different scales which can be produced by utilization of the read only memory 44 in the foregoing manner, is dependent only upon the size or capacity of read only memory provided.

From what has been said thus for with respect to the keyboard control logic 18, it should now be recognized that the logic 18 supplies an analog output signal on line 42 as represented in line (*h*) of FIG. 2 and a digital data signal on line 36 as represented in line (i) of FIG. 2. Further, the control logic 18 also supplies the six bit address code via conductors 50 to the channel logic units 22 for purposes to become clearer hereinafter.

CHANNEL SELECTION LOGIC

Attention is now called to FIG. 3 which comprises a logic block diagram of the channel selection logic 20 depicted in FIG. 1. The channel selection logic 20 includes a four bit digital counter 60 having four bit output terminals 62. The output terminals 62 are connected to the input of a one-of-ten state decoder 64 such that the decoder 64 provides a unique signal on one of its ten output lines 66, depending upon the state of the four bit counter 60. Although, as is well known, a four bit counter is capable of defining 16 different states, since we have assumed the existence of only ten voice channels, only ten of the states of counter 60 will be utilized. For each of the ten states defined by counter 60, the decoder 64 will provide a unique signal to one of its ten output lines. The ten output lines of the decoder 64 comprise ten channel select lines, each one being connected to a different channel logic unit in a manner to be described in connection with FIG. 4.

Prior to proceeding with the explanation of the channel selection logic 20 of FIG. 3, mention will be made of the nomenclature to be employed herein to represent logic levels. Hereinafter, reference will be made to high (+) and low (−) signal levels to represent the two possible binary states of a signal. Also, a signal or signal line may be referred to by a term including both a sign and word such as "+BUSY" or "−TAKEN." The signs "+" and "−" are intended to indicate the logic level of the signal when the signal is functionally active. That is, the term "+BUSY" should be understood to mean that is that signal is high, it indeed represents a busy condition. On the other hand, if the "+BUSY" signal is low, this represents a not busy condition. Similarly, when a "−TAKEN" signal is low, this indicates that a particular key is indeed taken.

The four bit counter 60 includes an enable input terminal 72. When a high level signal is applied to terminal 72, the counter 60 will be stepped in response to a pulse supplied to its clock input terminal 74. The counter 60 is reset in response to a low level signal applied to reset input terminal 76.

The enable input terminal 72 is connected to the +BUSY BUS 77 which is derived from the output of AND gate 78. The clock terminal 74 is connected to the output of fast clock pulse source 80 which, it should be understood, provides clock pulses at a rate considerably greater than that of system clock pulse source 32.

Reference will hereinafter be made to the logic circuitry connected to the reset input terminal 76 of counter 60 but for the sake of clarity, it is appropriate to disregard this circuitry at this point and to assume that the counter 60 is never reset. Under these conditions, the counter 60 will be stepped in response to a pulse provided by source 80 only when the output of AND gate 78 is high. As will be seen hereinafter, the +BUSY BUS signal will be high when the selected channel logic unit is busy. In this case, the counter 60 is promptly advanced by the fast clock pulse source 80 in order to locate a channel logic unit which is not busy. When a not busy channel logic unit is located, the signal level on the +BUSY BUS will go low and the counter 60 will stop on that count since counting requires the application of a high level signal to enable input 72. Let is now be assumed as an example that the counter 60 has stopped on the count identifying channel 2 meaning that the decoder 64 is applying a low level signal to channel select line 2.

CHANNEL LOGIC UNIT

Attention is now directed to FIG. 4 which illustrates one of the ten identical channel logic units. To facilitate explanation, it will initially be assumed that FIG. 4 depicts channel logic unit 2 corresponding to that selected by decoder 64. The channel logic unit includes a gate 90 having four input lines 92, 94, 96 and 98. The −TAKEN BUS 99 derived from the output of gate 100 (FIG. 3) is connected to the input line 92 of gate 90.

The −TAKEN BUS 99 will be low only if, in response to a key depression, one of the channel logic units recognizes the key as being a key that it is presently servicing. The input line 94 of gate 90 is derived from the data line 36 (−DATA) of multiplexer 34 (FIG. 1). Note that the signal applied to the input line 94 is logically inverted at the input to gate 90. The input line 96 is derived from the channel select line (−SELECT) of the decoder 64 of FIG. 3. The signal applied to input line 96 is logically inverted at the front end of gate 90. The input line 98 is derived from the +BUSY output terminal of gate 160 (FIG. 4) constituting part of the same channel logic unit. As will be seen hereinafter, the +BUSY signal of a channel logic unit is high when the key which it is servicing is depressed.

Thus, it should now be appreciated that the gate 90 in FIG. 4 will provide a high level output signal when (1) decoder 64 supplies a low level signal to input line 96 and (2) a low level signal appears on data line 36 coupled to input line 94 and (3) the gate 160 is in an inactive state meaning that the +BUSY signal is low and (4) no other channel logic unit is producing a low level signal on the −TAKEN BUS 99 out of gate 100 (FIG. 3). Under these conditions, the gate 90 will produce a high level output to the clock input terminal of a six bit storage register 106. Application of the high level output from gate 90 to the clock input of register 106 loads the six bit address from counter 30 (FIG. 1) into the register 106. Additionally, the six bit address is applied to the six bit compare circuit 108 causing the compare circuit 108 to supply a high level match signal on output terminal 110. Output terminal 110 is connected to the strobe input terminal 111 of a sample and hold circuit 112. The output terminal 42 of converter 40 (FIG. 1) is connected to the analog input 114 of the sample and hold circuit 112. In response to the high level signal supplied by compare circuit 108 to the strobe input terminal, the sample and hold circuit 112 will store the then existing level of the analog signal depicted in line (h) of FIG. 2. The output of the sample and hold circuit 112 is supplied as a control voltage 116 to the voice channel connected to the channel logic unit.

Additionally, the high level match signal supplied by compare circuit 108 on output line 110 is supplied to the input line 118 of gate 120. Assume that the input line 122 of gate 120 at this time is low. In this case, gate 120 will provide a low level output on terminal 124. Terminal 124 is connected to the input of gate 100 (FIG. 3) to produce a low level signal on the −TAKEN BUS 99 at the output of the gate 100. Thus, whenever the compare circuit 108 recognizes a match, and if input line 122 of gate 120 is low, then the −TAKEN BUS 99 at the output of gate 100 will also be low indicating that a match has been recognized and that the key has been taken by one of the channel logic units.

The output terminal 124 of gate 120 is also connected to the input line 126 of gate 130. A second input to gate 130 is derived from the output of previously mentioned gate 90. Gate 130 will provide a high level output when either (1) the output of gate 90 is high or (2) the output of gate 120 is low. These situations will occur when either a new key address is being entered into the register 106 or when the compare circuit 108 is recognizing a match between a key and a previously stored key address.

The output of gate 130 is connected to the clock input terminal 134 of previously mentioned flip flop 102. When the output of gate 130 is high, the flip flop 102 is set to a state determined by the signal level on data line 36 (FIG. 1) applied to the flip flop input terminal 136. If −DATA signal is low, flip flop 102 is switched to a set state such that the −GATE terminal 138 is low and the +GATE terminal 140 is high. It will be recalled that the +GATE terminal 140 being high indicates that the channel logic unit is activating the voice channel connected thereto to produce sounds. If when gate 130 supplies an enabling input to clock input terminal 134, the −DATA signal is high meaning that the key being serviced by that channel logic unit is no longer depressed, then the flip flop 102 is reset and the +GATE signal terminated.

The flip flop 102 will remain in the set state through as many scan cycles as the key remains depressed. That is, it should be recognized that the gate 130 will continue to apply a clock pulse to input terminal 134 of gate 102 once every scan cycle during the time slot corresponding to the address stored by the register 106. The flip flop 102 will remain set to provide a high +GATE signal only so long as the −DATA signal applied to flip flop input 136 coincident with the clock pulse provided by gate 130 to flip flop clock input 134 remains low.

In previously considering the action of gate 120, it was assumed that a low level signal was applied to input 122 of gate 120. As was mentioned, this action produced a low level signal at the output of gate 120 which essentially activated the −TAKEN BUS (FIG. 3). The purpose of gate 150 connected to input 122 of gate 120 is essentially to defeat generation of the TAKEN signal so as to permit a subsequent depression of the same key to be reassigned to an additional channel logic unit.

More particularly, in accordance with a feature of the invention, it is desirable for the synthesizer of FIG. 1 to be able to selectively operate in two modes; namely a REASSIGN mode and a NON-REASSIGN mode. In the NON-REASSIGN mode which has been discussed thus far, if a key is "taken," that is if its address is stored within one of the channel logic units, then the key will not be assigned to a different channel logic unit. Thus, in the NON-REASSIGN mode, multiple depressions of a key will merely continue to activate only one voice channel because on each depression, the channel logic unit of that voice channel will advise all of the other channel logic units that the key is taken. On the other hand, in the REASSIGN mode, multiple depressions of a key will permit that key to be assigned to multiple voice channels The musical effect is that in the NON-REASSIGN mode, multiple depressions of the key will cause the same voice channel to attack and decay a number of times. In the REASSIGN mode, multiple depression of a key will cause multiple voice channels to independently attack and decay, thereby producing together the rich sound of multiple sources beating and changing in phase.

The REASSIGN mode is determined by a user switch 154 (FIG. 3). It will be presumed that when the switch is closed, the REASSIGN mode is defined and when the switch is open, the NON-REASSIGN mode is defined. In presuming input line 122 of gate 120 to be low, we have assumed the NON-REASSIGN mode. However, if the switch 154 (FIG. 3) is closed to define the REASSIGN mode, then a low level signal will be supplied to input 156 of gate 150 and if the +GATE signal applied to input 158 is also low (meaning that the key was released), then the output of gate 150 will be high to thereby inhibit the generation of the low level signal out of gate 120. Mention was previously made of gate 100 (FIG. 3) which responds to a low level signal applied to any of its input lines 101 to produce a low level signal on the −TAKEN BUS 99.

Mention was previously made of gate 78 (FIG. 3) which supplies a high level signal on its output coupled to the +BUSY BUS 77 to identify when the channel selected by the decoder 64 is busy. The inputs 79 to gate 78 comprise the outputs from gates 160 of the channel logic units. When all of the inputs to gate 78 are high, then the +BUSY BUS 77 is active enabling the four bit counter to be stepped to a next count. The gate 160 (FIG. 4) supplies a high output whenever it is not selected by the corresponding channel select line 66 from channel select logic (FIG. 3); that is, when a high level signal is applied to input 162 of gate 160. The only channel logic unit which can supply a low level signal to the input of gate 78 (FIG. 3) is the channel logic unit which is selected. The selected channel logic unit will provide a low output on gate 160 if its +GATE signal derived from terminal 140 of flip flop 102 is low, meaning that it is not servicing a depressed key or, in other words, is not busy. In accordance with a further feature of the invention, a selectively actuatable busy input line 163 is connected to the input of each gate 160. The input line 163 includes a switch which can be selectively closed by the user to apply a high level input to gate 160 so as to make the voice channel appear busy to the channel selection logic. In this manner, one or more of the voice channels can be inoperative without adversely affecting system operation.

From the foregoing, it should now be recognized that each channel logic unit is capable of storing the address of a key in its register 106. When that key is depressed and for so long as it remains depressed, that channel logic unit will continue to supply a high level +GATE signal on terminal 140 of flip flop 102 which will activate the voice channel connected thereto. The voice channel will respond to the control voltage supplied by the sample and hold circuit 112. After the key is released, the +GATE signal on terminal 140 will fall to a low level but the control voltage supplied by the sample and hold circuit 112 will still be available to the voice channel to enable the voice to properly decay. If a key assigned to a particular channel logic unit is released and then again depressed, that same channel logic unit will, if it still stores the key address in register 106, indicate to the other channel logic units that the key is taken. If operating in the REASSIGN mode, the taken indication is inhibited so as to permit a key to be assigned to an additional channel logic unit should the channel selection logic so demand. It should also be recognized that once a key is assigned to a channel logic unit, no subsequent key depression can preempt or acquire that channel logic unit and its connected voice channel until the originally assigned key is released.

Returning now to FIG. 3, reference will now be made to the RESET mode logic connected to the reset input terminal 76 of the counter 60. The system enables the user to define three different RESET modes for different musical effects. The three different modes are respectively defined as (1) NEVER, (2) ALWAYS, and (3) SOMETIMES. The terms NEVER, ALWAYS, and SOMETIMES refer to the conditions under which the counter 60 is reset. Selection of a particular RESET mode determines the compromise between control of which voice channel goes to which key and how long the associated sustain time can be. In the NEVER mode, the assignments of keys to voice channels is most uniform and hence each voice channel has the longest period to decay after key release before reassignment. In the SOMETIMES mode, a series of single key depressions will result in only the lowest numbered voice channel being assigned, but as soon as more keys are depressed, the more even distribution characteristic of the NEVER mode is achieved. The SOMETIMES mode is particularly useful in situations where the lowest numbered voice channel is set to an audibly different timbre which the musician desires to selectively control. In the ALWAYS mode, the sustain times available are minimal, but the simple rule that the depressed key will be assigned to the lowest numbered available voice channel is achieved. The ALWAYS mode gives the musician maximum control over the assignment of specific keys to voice channels.

In the NEVER mode the counter 60 is never reset and this has been the mode assumed in the description thus far. In the ALWAYS mode the counter 60 is reset once per scan cycle. In the SOMETIMES mode, the counter 60 is reset after each scan cycle in which no key depressions are sensed.

In order to define the NEVER mode, switch 200 is closed to supply a high level signal to one input of gate 202. This necessarily produces a low level on output 204 which in turn assures a high level out of gate 206 to the reset terminal 76 of counter 60. Since the application of a low level signal to terminal 76 is required to reset the counter 60, closure of switch 200 to define the NEVER reset mode assures that the counter 60 is never reset.

Now consider the situation when the switch 200 is open and the switch 208 is closed to define the ALWAYS mode. Closure of switch 208 applies a high level to input 210 of gate 212. This assures a low level out of gate 212 to input 214 of gate 202. Thus gate 202 will supply a high level signal to input 204 of gate 206. If input 216 to gate 206 is also high, then gate 206 will produce the low level signal to reset the counter 60. The input 216 to gate 206 is derived from terminal Q of a one shot multivibrator 218. One shot 218 is provided to sense the end of a scan cycle, as defined by the address counter 30 (FIG. 1). It will be recalled from line (g) of FIG. 2 that address counter output line A6 will change state at the midpoint and at the end of a scan cycle. The one shot 218 is set in response to the negative going transition of the signal on output line A6. As a consequence, a short positive pulse is developed on terminal Q of flip flop 218 and supplied to input 216 of gate 206. Thus, gate 206 will provide a low level pulse to reset terminal 76 of counter 60 once per scan cycle.

From what has been said thus far, it should be recognized that the one shot 218 produces a positive pulse on its Q output and a negative pulse on its Q output at the end of every scan cycle. In the SOMETIMES mode, the negative end of scan pulse is used to reset flip flop 220 which functions to sense whether a key depression has occurred within a scan cycle. That is, whenever a key depression is sensed, inverter 224 sets flip flop 220 producing high and low levels respectively on its outputs Q and Q. The Q output of flip flop 220 is connected to the input of gate 212. If a key depression is sensed during a scan, then flip flop 220 output Q will be low, gate 212 output will be high, gate 202 output will be low and thus gate 206 will be prevented from producing a low output when one shot 218 supplies the positive pulse on input 216 of gate 206. However, since flip flop 220 is reset at the beginning of every scan cycle, then during the first scan cycle after a scan cycle in which no key is depressed (i.e. flip flop 220 is not set), gate 206 will supply a low level pulse to counter input 76 to reset the counter 60.

From the foregoing, it should now be appreciated that an electronic music synthesizer has been disclosed herein which incorporates a plurality of voice channels which are able to respond to depressions of multiple keys to independently and concurrently produce sounds as determined by those keys. More particularly, it should be recognized that a digital keyboard control system has been disclosed herein for responding to a conventional keyboard so as to control multiple voice channels to produce musically pleasing effects.

Although the preferred embodiment of the invention is disclosed as comprising a special purpose digital apparatus, it is recognized, of course, that the invention can be embodied in a properly programmed general purpose digital computer. Accordingly, it is intended that such a variation and all other such variations and modifications be deemed to fall within the scope of the claims herein.

The embodiments of the invention in which an exclusive property or privilege is claimed are defined as follows:

1. A music synthesizer comprising:

a plurality of M keys each capable of defining an open or closed state;

a plurality of N voice channel means where N <m;

keyboard scan means for cyclically sequentially sampling said M keys to produce a series of bit signals, each indicative of the state of a different one of said keys;

N channel logic means each including an address register;

channel selection means coupled to said channel logic means and responsive to each sampled key in a closed state for storing an address identifying that key in one of said N address registers;

each of said channel logic means including means responsive to said series of bit signals for producing a gate signal having a duration related to the number of successive scan means cycles in which the key identified by the address stored in said channel logic means is in a closed state;

each of said channel logic means including means responsive to the address stored in the address register means thereof for producing a control voltage having a level related to that stored address; and means for applying said gate signal and control voltage signal produced by each of said channel logic means to a different one of said N voice channels.

2. The synthesizer of claim 1 including means for sequentially producing M different key addresses in synchronism with said scan means sampling said M keys, said means for producing key addresses comprising a source of clock pulses;

address counter means responsive to said clock pulses for producing M unique digital addresses; and means coupling said address counter means to said N channel logic means address registers.

3. The synthesizer of claim 2 including digital to analog converter means responsive to said address counter means for producing an analog voltage having a level related to said digital addresses produced thereby; and means coupling said digital to analog converter to each of said channel logic means.

4. The synthesizer of claim 3 wherein said means in each of said channel logic means for producing a control voltage comprises a sample and hold circuit responsive to said analog voltage.

5. The synthesizer of claim 1 further including scale selection means for selectively varying the relationship between said control voltage level produced and the stored address.

6. The synthesizer of claim 2 wherein each of said channel logic means includes a compare means for producing a match signal responsive to said address produced by said address counter means matching the address stored in the address register thereof.

7. The synthesizer of claim 1 wherein said channel selection means includes channel counter means capable of defining N successive states, each identifying a different one of said N channel logic means;

means responsive to said channel counter means identifying a channel logic means producing a gate signal for incrementing said channel counter means to a subsequent state; and wherein said channel selection means includes means for storing said address identifying a key in a closed state in the channel logic means identified by the state of said channel counter means.

8. The synthesizer of claim 7 including selectively actuatable means for resetting said channel counter means during every scan means cycle.

9. The synthesizer of claim 7 including selectively actuatable means for resetting said channel counter means during each scan means cycle subsequent to a cycle in which no keys are sampled in a closed state.

10. The synthesizer of claim 6 including means for defining a NON-REASSIGN mode; and means operative in said NON-REASSIGN mode and responsive to the production of said match signal for preventing said channel selection means from storing said address.

11. The synthesizer of claim 6 wherein said means for producing said gate signal includes:

gate flip flop means; and means responsive to said match signal for switching said gate flip flop to a first state if the concurrently produced bit signal indicates a closed key state and to a second state if the concurrently produced bit signal indicates an open key state.

12. In a music synthesizer comprised of a keyboard of M keys and a plurality of N voice channels, where N<M, each voice channel being responsive to a control voltage and a gate signal applied thereto for producing a sound whose frequency and duration are determined respectively by said control voltage and gate signal, the improvement comprising a control system for monitoring the states of said keys to produce, with respect to each closed key, a control voltage and gate signal for application to one of said voice channels, said control system comprising:

counter means for cyclically producing a series of M unique addresses, each address identifying a different one of said M keys;

means responsive to each of said M addresses for sampling the state of the identified key to produce a data signal comprised of successive bit signals, each at a first or second level respectively indicative of an open or closed key state;

N channel logic means each connected to a different one of said voice channels, each of said channel logic means including register means capable of storing a key address;

channel selection means responsive to said data signal produced by said sampling means defining said second level indicative of a closed key state for storing the address identifying that key in one of said N channel logic means registers;

means in each of said N channel logic means for producing a gate signal with respect to the key identified by the address stored therein representing the time duration that the key remains in said closed state; and means in each of said N channel logic means for producing a control voltage having a level related to the address therein.

13. The music synthesizer of claim 12 including digital to analog converter means responsive to said counter means for producing an analog voltage having a level related to the address produced by said counter means ; and means for applying said analog voltage to each of said channel logic means.

14. The music synthesizer of claim 13 wherein each of said channel logic means includes a compare means for producing a match signal responsive to said address produced by said counter means matching the address stored in the register thereof.

15. The music synthesizer of claim 14 wherein said means for producing a control voltage comprises a sample and hold circuit responsive to said analog voltage and said match signal.

16. The music synthesizer of claim 14 including means for selectively defining either a REASSIGN or NONREASSIGN mode; and means operative in said NON-REASSIGN mode and responsive to the production of said match signal for preventing said channel selection means from storing said address.

17. The music synthesizer of claim 16 including means operative in said REASSIGN mode for inhibiting said means for preventing said channel selection means from storing said address.

18. The music synthesizer of claim 12 wherein said channel selection means includes channel counter means capable of defining N successive states, each identifying a different one of said N channel logic means;

means responsive to said channel counter means identifying a channel logic means producing a gate signal for incrementing said channel counter means to a subsequent state; and further including means for storing said address identifying a key in a closed state in the channel logic means identified by the state of said channel counter means.

19. The music synthesizer of claim 12 including:

a gate flip flop; and means responsive to said match signal for switching said gate flip flop to a first state if the concurrently produced bit signal indicates a closed key state and to a second state if the concurrently produced bit signal indicates an open key state.

* * * * *

Notice of Adverse Decision in Interference

In Interference No. 99,905, involving Patent No. 3,986,423, D. P. Rossum, POLYPHONIC MUSIC SYNTHESIZER, final judgment adverse to the patentee was rendered Oct. 27, 1980, as to claims 1-9, 11-15, 18 and 19.

[*Official Gazette August 25, 1981.*]

Notice of Adverse Decision in Interference

In Interference No. 100,097, involving Patent No. 3,986,423, D. P. Rossum, POLYPHONIC MUSIC SYNTHESIZER, final judgment adverse to the patentee was rendered June 16, 1982, as to claim 16.

[*Official Gazette August 17, 1982.*]